United States Patent [19]

Kasegi et al.

[11] Patent Number: 4,788,387

[45] Date of Patent: Nov. 29, 1988

[54] LIMIT SWITCH WITH CURVED OR PARTLY SPHERICAL CONVEX COVER

[75] Inventors: Hiroshi Kasegi; Takao Kitamura, both of Kurayoshi, Japan

[73] Assignee: Omron Tateisi Electronics Co., Kyoto, Japan

[21] Appl. No.: 924,904

[22] Filed: Oct. 30, 1986

[30] Foreign Application Priority Data

Oct. 30, 1985 [JP] Japan ..... 60-241623

[51] Int. Cl.[4] ..... H01H 13/06

[52] U.S. Cl. ..... 200/47; 200/302.1; 200/308; 200/317

[58] Field of Search ..... 200/47, 302.1, 302.2, 200/308, 310, 312, 317, DIG. 42, 294; 219/137.43

[56] References Cited

U.S. PATENT DOCUMENTS

| | | | |
|---|---|---|---|
| 2,137,481 | 11/1938 | Furnas et al. | 200/294 |
| 2,289,643 | 7/1942 | Furnas et al. | 200/47 X |
| 2,575,820 | 11/1951 | Linton | 200/317 |
| 2,900,958 | 8/1959 | Johnson | 200/294 X |
| 3,168,636 | 2/1965 | De Smidt | 200/317 |
| 3,179,777 | 4/1965 | Rohacs | 200/317 |
| 3,239,648 | 3/1966 | Syrigos | 219/137.43 |
| 3,243,571 | 3/1966 | Schmerling | 219/137.43 |
| 3,275,764 | 9/1966 | Kiessling et al. | 200/47 |
| 3,421,142 | 1/1969 | Kircher | 200/317 |
| 3,430,837 | 3/1969 | Hein | 219/137.43 X |
| 3,536,888 | 10/1970 | Borneman | 219/137.43 |
| 3,597,576 | 8/1971 | Bernard | 219/137.43 |
| 3,676,640 | 7/1972 | Bernard et al. | 219/137.43 |
| 3,740,504 | 6/1973 | Hipple | 200/47 |
| 3,959,614 | 5/1976 | Grainger | 200/47 |
| 4,002,872 | 1/1972 | Desio | 200/294 |
| 4,218,603 | 8/1980 | Satoh | 200/312 |
| 4,242,598 | 12/1980 | Atsumi | 200/47 |
| 4,459,441 | 7/1984 | Hermle et al. | 200/47 |
| 4,556,768 | 12/1985 | Atsumi et al. | 200/302.2 |
| 4,575,612 | 3/1986 | Prunier | 219/137.43 |

FOREIGN PATENT DOCUMENTS

| | | | |
|---|---|---|---|
| 588574 | 12/1959 | Canada | 200/294 |
| 2254765 | 11/1972 | Fed. Rep. of Germany | 200/317 |
| 5164419 | 11/1974 | Japan | 219/137.43 |
| 0010350 | 1/1980 | Japan | 219/137.43 |
| 0146480 | 9/1982 | Japan | 219/137.43 |

OTHER PUBLICATIONS

IBM Tech. Disclosure Bull., vol. 19, No. 2, 7-1976, "Control Panel", pp. 405, 406, GE Brochure Limit Switches.

*Primary Examiner*—Henry J. Recla
*Assistant Examiner*—Ernest G. Cusick
*Attorney, Agent, or Firm*—Wegner & Bretschneider

[57] ABSTRACT

A limit switch includes a casing, a switch mechanism housed in the casing, a cover covering the casing, and an actuator mounted in the casing for operating the switch mechanism, the cover having a curved or partly spherical convex surface. The cover has at least a transparent or semitransparent portion, and a rating plate is disposed against a back of the transparent or semitransparent portion of the cover. The curved or partly spherical convex surface of the cover prevents spatter expelled from a welding machine from being deposited thereon. Since the spatter is not deposited directly on the rating plate, indications on the rating plate and the energization of an operation indication lamp within the cover can reliably be confirmed.

6 Claims, 5 Drawing Sheets

LIMIT SWITCH WITH CURVED OR PARTLY SPHERICAL CONVEX COVER

BACKGROUND OF THE INVENTION

The present invention relates to a limit switch for use as a switch for detecting an object on a conveyor line or the like.

When a limit switch is used near a welding machine, spatter or melted metal particles expelled from the welding machine can be deposited on moving parts of the switch, the area in which the switch is installed, and the indication area on the switch, possibly causing an operation failure of the switch or making the indications invisible.

SUMMARY OF THE INVENTION

It is an object of the present invention to provide an improved limit switch which is constructed to prevent spatter from being deposited thereon.

According to the present invention, there is provided a limit switch including a casing, a switch mechanism housed in the casing, a cover covering the casing, and an actuator mounted in the casing for operating the switch mechanism, the cover having a curved or partly spherical convex surface.

The curved or partly spherical convex surface of the cover prevents spatter expelled from a welding machine from being deposited thereon. Therefore, failure of the limit switch to operate is prevented and indications on the cover remain visible.

According to the present invention, there is also provided a limit switch including a casing, a switch mechanism housed in the casing, a cover covering the casing and having at least a transparent or semi-transparent portion, a rating plate disposed against a back of the transparent or semitransparent portion of the cover, and an actuator mounted in the casing for operating the switch mechanism.

Since spatter from a welding machine is not deposited directly on the rating plate, indications on the rating plate and the energization of an operation indication lamp within the cover can reliably be confirmed.

The above and other subjects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENT

Figure 1:
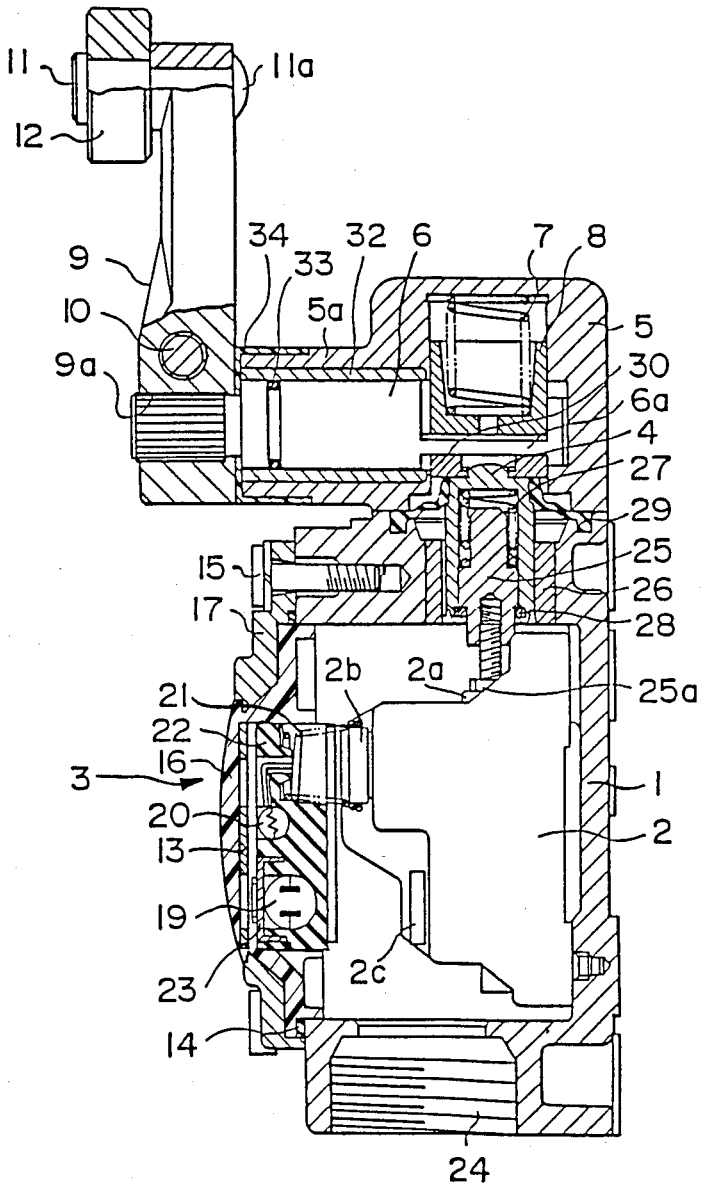
FIG. 1 is a cross-sectional view of a limit switch according to an embodiment of the present invention.

Like or corresponding parts are denoted by like or corresponding reference characters throughout the views.

Figure 10:
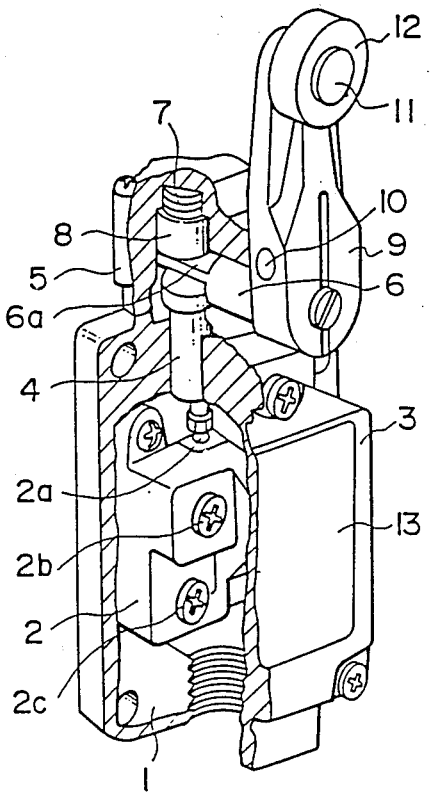
FIG. 10 is a perspective view, partly broken away, of a conventional limit switch.

FIG. 10 shows a conventional limit switch by way of example. The limit switch includes a casing 1 housing a switch mechanism 2 with its upper portion covered by a cover 3. The switch mechanism 2 includes an actuating member 2*a* which is operated upon by a plunger 4 movable by a rotatable shaft 6 disposed in a head 5 mounted on the casing 1. The rotatable shaft 6 has a flat portion 6*a* on its end disposed in the head 5. The rotatable shaft 6 is normally held in a neutral position by a plunger 8 pressed against the flat portion 6*a* of the shaft 6 under the resiliency of a compression coil spring 7 placed in the head 5. An actuating lever 9 has one end fixed to the opposite end of the rotatable shaft 6 by a hexagon socket head bolt 10. A roller 12 is rotatably mounted by a roller shaft 11 on the other end of the actuating lever 6. A rating plate 13 is attached to the cover 3.

The limit switch 1 of this construction may be used on a conveyor line. When a dog on the conveyor is moved into engagement with the roller 12 to turn the lever 9, the flat portion 6*a* of the rotatable shaft 6 is angularly moved to push the plunger 4. The actuating member 2*a* is pushed by the plunger 4 to operate the switch mechanism 2. Such an operation of the switch mechanism 2 can be detected through terminal screws 2*b* and 2*c*. As the dog moves past the limit switch 1, the lever 9 returns to its neutral position since the rotatable shaft 6 returns to the neutral position under the resiliency of the compression coil spring 7 in the head 5. The plunger 4 now releases the actuating member 2*a*.

The conventional limit switch is rugged in construction and reliable in operation when used in normal environments. However, when it is used in the vicinity of an arc welding machine or a spot welding machine, melted metal particles or spattered expelled from the welding machine can be deposited on the casing. The spatter deposit grows until it causes an operation failure of the limit switch. When the spatter is deposited on the actuating lever, the limit switch is apt to fail quickly due to the spatter interfering with the movement of the moving parts. When the spatter is deposited on the rating plate, the indications on the rating plate cannot be confirmed. If the rating plate has a window for visually checking the energization of an operation indicating lamp within the cover, the spatter layer on the window prevents such visual checking of the lamp.

The present invention will now be described with reference to FIGS. 1 through 9.

Figure 2:
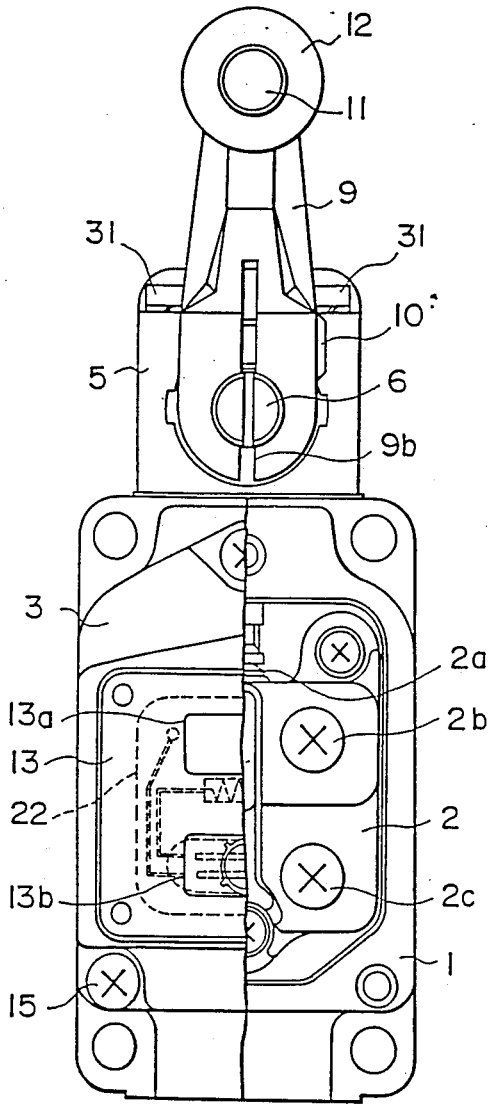
FIG. 2 is a front elevational view, partly cut away, of the limit switch shown in FIG. 1.

FIGS. 1 and 2 show a limit switch according to an embodiment of the present invention. The limit switch includes a casing 1 in the form of a rectangular box in which a dual-circuit double-break switch mechanism 2 is fixedly disposed by screws through an insulating piece of cloth. The casing 1 has an opening closed by a cover 3 through a gasket 14, the cover 3 being secured to the casing by screws 15.

The cover 3 comprises a transparent or semi-transparent resin member 16 and an aluminum die-cast member 17 which are assembled together by outsert molding. The resin member 16 has a recess defined in the back thereof. A rating plate 13 is inserted in the recess of the resin member 16, and a lamp holder cover 22 of rubber with a neon lamp 19, a resistor 20, and a contact spring 21 mounted therein is placed in the recess over the rating plate 13. A transparent or semitransparent lamp indicator plate 23 is placed over the neon lamp 19. The contact spring 21 contacts a normally open terminal 2*b* when the cover 3 is mounted on the casing 1. The switch mechanism 2 has two normally open terminals 2*b* and two normally closed terminals 2*c* to which there are connected terminals of lead wires introduced through a connector into a conduit hole 24 defined in the casing 1.

The switch mechanism 2 has an actuating member 2*a* contacted by a tip end 25*a* of an auxiliary plunger 25, which is slidably inserted into an actuating plunger 4 slidably mounted in the casing 1 by a bearing 26, with a protective compression spring 27 interposed between the auxiliary plunger 25 and the actuating plunger 4. The auxiliary plunger 25 is retained in place by a stopper ring 28 fitted in the open end of the actuating plunger 4. A sealing cap 29 of rubber and a contact member 30 are force-fitted over the distal end of the actuating plunger 4.

A head 5 is secured to the casing 1 by four screws 31 so that head 5 covers the tip end of the actuating plunger 4. A return plunger 8 is slidably inserted in the head 5 in coaxial relation to the actuating plunger 4, the return plunger 8 being normally urged by a compression coil spring 7 toward the actuating plunger 4. The head 5 also houses therein a rotatable shaft 6 extending in a direction normal to the axis of the return plunger 8 and rotatably supported by a bearing 32. The rotatable shaft 6 is recessed at opposite surfaces facing the return plunger 8 and the actuating plunger 4 and defining a flat cam 6*a*. The return plunger 8 and the contact member 30 on the tip end of the actuating plunger 4 are pressed respectively against the opposite surfaces of the cam 6*a* under the resilient forces of the springs 7 and 27 to keep the rotatable shaft 6 in a neutral position.

The rotatable shaft 6 has one end projecting from a boss 5*a* of the head 5, with an O-ring 33 interposed between the bearing 33 and the shaft 6. A cylindrical cap 34 of resin is fitted over the distal end of the boss 5*a* and has a hole through which the end of the rotatable shaft 6 extends. The projecting end of the rotatable shaft 6 is fitted in an attachment hole 9*a* defined in one end of an actuating lever 9. The actuating lever 9 has a slot 9*b* defined longitudinally across the attachment hole 9*a*. The actuating lever 9 is fastened to the rotatable shaft 6 by tightening a hexagon socket head bolt 10 which is threaded through the lever 9 across the slot 9*b*. A roller 12 is rotatably mounted on the distal end of the actuating lever 9 by a roller shaft 11 that is fixed to the lever 9 by staking its end 11*a*.

The components ranging from the head 5 to the roller 12 jointly constitute the actuator of the limit switch. The four screws 31 by which the head 5 is attached to the casing 1 are positioned equidistantly around the axis of the actuating plunger 4 and extend in the same direction, so that the head 5 can be oriented with respect to the casing 1 in any of four 90-degree-spaced directions.

Operation of the limit switch thus constructed will be described below.

When the roller 12 on the distal end of the lever 9 is hit by a dog or the like and turned thereby, the shaft 6 secured to the lever 9 is also turned. The angular movement of the shaft 6 causes the cam 6*a* thereof to push the contact member 30 which moves the actuating plunger 4 in a direction out of the head 5. This movement of the actuating plunger 4 is transmitted through the spring 27 to the auxiliary plunger 25 which causes the tip end 25*a* thereof to push the actuating member 2*a*, thus turning on the switch mechanism 2. When the auxiliary plunger 25 is advanced a certain interval to cause the actuating member 2*a* to reach its stroke limit, any further angular movement of the lever 9 is absorbed by continued displacement of the actuating plunger 4 while compressing the spring 27.

When the roller 12 on the lever 9 is released from the dog, the lever 9 returns to its neutral position under the resiliency of the return spring 7 which presses the return plunger 8 against the cam 6*a* of the shaft 6. The actuating plunger 4 also returns under the resiliency of the spring 27, thereby turning off the switch mechanism 2.

The rating plate 13 has two spaced windows 13*a* and 13*b* of identical shape, as shown in FIG. 2. The energization of the neon lamp 19 can be confirmed through one of these windows. The neon lamp 19 is mounted in the lamp holder cover 22 disposed behind the cover 3. If the lamp holder cover 22 is fitted behind the cover 3 so as to allow the neon lamp 19 to be viewed through the window 13*b*, as shown, the contact spring 21 contacts the normally open terminal 2*b* of the switch mechanism 2, so that the neon lamp 19 is energized only wnen the switch mechanism 2 is turned off, indicating that the switch is not in operation. Conversely, if the lamp holder cover a 22 in attached so that the neon lamp 19 can be viewed through the window 13*a*, the contact spring 21 contacts the normally closed terminal 2*c* of the switch mechanism 2. Therefore, the neon lamp 19 is energized only when the switch mechanism 2 is turned on to indicate that the switch is in operation. Such operative or inoperative condition of the switch is indicated by the lamp indicator plate 23 placed in front of the neon lamp 19 and bearing an indication mark.

The casing 1 and the head 5 comprise die castings of an aluminum alloy, and the lever 9 comprises a casting of an aluminum alloy. The casing 1, the head 5, and the lever 9 are coated with a melamine layer for preventing spatter from being deposited thereon. These components can be coated with any of various materials which are highly resistant to heat and allow spatter deposits to be separated easily. For example, these components may be coated with a resin such as polytetrafluorethylene, silicone, silicon fluoride, glass resin, or a rubber or ceramics material, or may be plated with a metal such as nickel, chromium, or the like. The surfaces of the casing 1, the head 5, and the lever 9 are required to have smooth surfaces in order to allow spatter deposits to be separated easily.

Alternatively, the casing 1, the head 5, and the lever 9 themselves may be made of these materials. The desired materials also include stainless steel, and the roller shaft 11, the roller 12, the hexagon socket head bolt 10, and the screws 31 are made of stainless steel.

The entire limit switch, including the casing 1, resin cap 34 and the cover 3, may be coated with or made of any of the above desired materials. At least the movable and support components, i.e., the lever 9 and the head 5, and the roller 12 and the lever 9, need to be coated with or made of any of the above desired materials.

Figure 3:
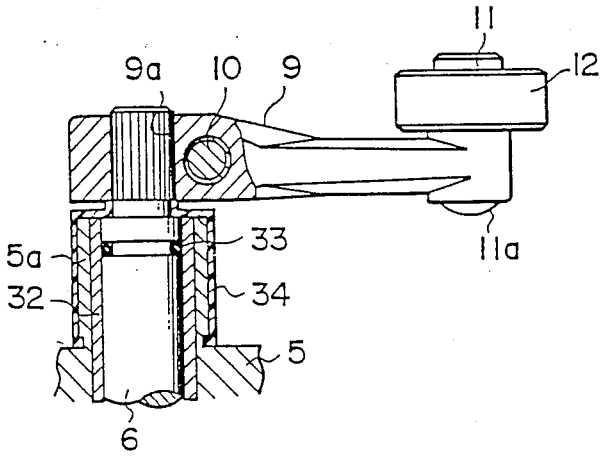
FIG. 3 is a fragmentary cross-sectional view showing a resin cap according to another embodiment of the present invention.

The resin cap 34 is disposed between the lever 9 and the head 5 for its heat resistance and ability to allow spatter deposits to be separated. Although the resin cap 34 is made of polytetrafluoroethylene in the illustrated embodiment, it may be formed of any other resin material which is heat-resistant and from which spatter deposits can easily be separated. As shown in FIG. 3, the boss 5*a*, together with the rotatable shaft 6, may be entirely covered by the resin cap 34. Since the resin cap is flexible, it can be attached more easily and has a better sealing capability than it would if it were formed of other materials.

Figure 4:
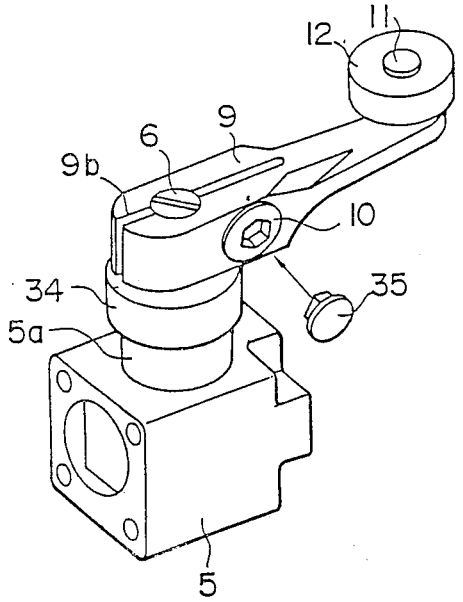
FIG. 4 is a perspective view of an actuator having a cap for a hexagon socket head bolt.
Figure 5:
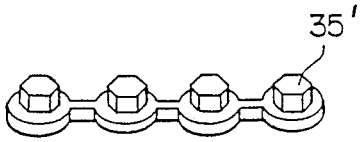
FIG. 5 is a perspective view of caps for a hexagon socket head bolt.
Figure 6:
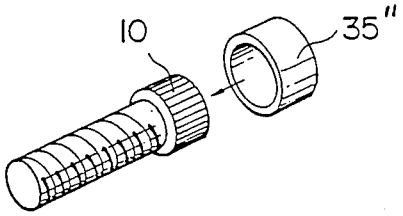
FIG. 6 is a perspective view of a cap according to still another embodiment for a hexagon socket head bolt.

As shown in FIG. 4, the head of the hexagon socket head bolt 10 by which the lever 9 is fixed to the rotatable shaft 6 may be covered with a cap 35 made of a similar resin or rubber material. The cap 35' may be separated from a series of caps which are made of silicon rubber as shown in FIG. 5. the cap 35' may be shaped to cover the entire head of the hexagon socket head bolt 10 as shown in FIG. 6, or may be arranged to cover the head of another screw or close an attachment hole after the screw has been attached.

Figure 7:
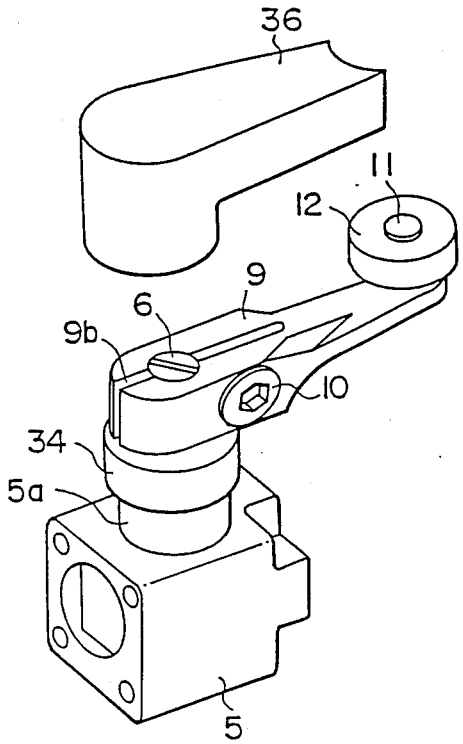
FIG. 7 is a perspective view showing a cover for preventing spatter from being deposited.

As shown in FIG. 7, the lever 9 and the boss 5*a* of the head 5 on which the lever 9 is supported may be covered with a cover 36 made of a similar resin, rubber, or metal material. The cover 36 may cover the whole assembly of the lever 9, the head 5, and the casing 1. In such a case, the cover should be large enough to allow the lever 9 to be moved with respect to the casing 1, or should have a flexible portion between the lever 9 and the casing 1.

In addition to the coating on or the material of the cover and other components for the prevention of spatter deposits, one component is shaped for such spatter deposit prevention. More specifically, the cover 3 on the casing 1 has a curved convex surface as shown in FIG. 1. The curved convex surface may be a cylindrical surface having a vertical curvature, a cylindrical surface having a horizontal curvature, another curved convex surface, a partly spherical convex surface such for example as an elliptically or circularly spherical surface, or a combination of some of those convex surfaces. The curved convex surface or partly spherical surface of the cover 3 serves to scatter spatter from a welding machine into various directions when the spatter hits the cover 3. Therefore, spatter deposits are not easily formed on the cover 3. Where the cover 3 is made of a transparent resin, the cover 3 has a lens effect to allow the indications on the rating plate 13 behind the transparent resin member 16 to be clearly visible.

Figure 8:
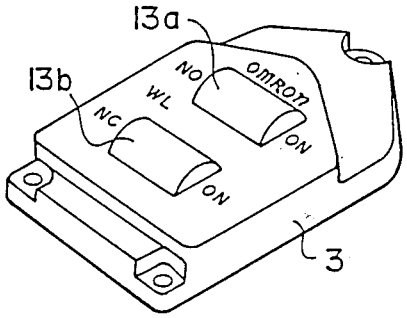
FIGS. 8 and 9 are perspective views of case covers according to other embodiments of the present invention.
Figure 9:
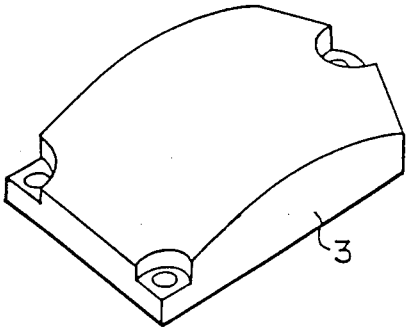

As shown in FIG. 8, curved convex surfaces or partly spherical convex surfaces may be formed only over the windows 13*a* and 13*b* of the rating plate 13. Where the limit switch has an operation indicator lamp as shown, it is important to confirm the switch operation by visually checking the energization of the lamp. The curved convex surfaces or partly spherical convex surfaces over the windows 13*a* and 13*b* prevent spatter from being deposited over the windows 13*a* and 13*b* through which the lamp energization is to be confirmed, and also allows light from the lamp to be scattered by the lens effect.

In the illustrated embodiment, the cover 3 is formed by assembling the transparent resin member 16 of polybutylene terephthalate and the aluminum die-cast member 17 through the outsert molding process. However, the cover 3 may be molded of transparent resin. Where no operation indication lamp is employed, the entire cover 3 may be formed of opaque resin or a metallic material such as die-cast aluminum. It is preferable for higher heat resistance to coat the curved convex surface or partly spherical convex surface or the resin surface with a highly heat resistant material such as glass resin, ceramics, polytetrafluoroethylene, silicone, silicone fluoride, for example. Where an operation indicator lamp is employed, the coating material is required to be transparent or semitransparent. Rather than coating the above materials, a sheet of any of these materials may be applied to the curved convex surface or partly spherical convex surface or the resin surface.

Although certain preferred embodiments have been shown and described, it should be understood that many changes and modifications may be made therein without departing from the scope of the appended claims.

What is claimed is:

1. A limit switch for use in the vicinity of a welding machine comprising:

a casing;

a switch mechanism housed in said casing;

a cover covering said casing; and an actuator mounted in said casing for operating said switch mechanism, wherein said cover has an inner face and an outer face, said inner face being substantially flat and said outer face being spherically curved with respect to said inner surface, so as to scatter welding spatters, thus inhibiting the spatters from adhering to said outer face.

2. A limit switch for use in the vicinity of a welding machine comprising:

a casing;

a switch mechanism housed in said casing;

a cover covering said casing and having at least a transparent or semitransparent portion;

a rating plate disposed between said casing and said transparent or semitransparent portion of said cover; and an actuator mounted in said casing for operating said switch mechanism, wherein said cover has an inner face and an outer face, said inner face being substantially flat and said outer face being spherically curved with respect to said inner surface, so as to scatter welding spatters from adhering to said outer face.

3. A limit switch according to claim 1 or 2, further comprising a head mounted on said casing and including a boss, said actuator including a rotatable shaft rotatably disposed in said boss, and a resin cap covering said boss and said rotatable shaft.

4. A limit switch according to claim 3, wherein the cover and cap are coated with a composition that is resistant to heat and formation of welding spatter deposits thereon.

5. A limit switch according to claim 4, wherein the composition is selected from the group consisting of polytetrafluoroethylene, silicone, silicone fluoride, glass resin, rubber or ceramic.

6. A limit switch according to claim 1, wherein the cover is plated with nickel or chromium.

* * * * *